US010683874B2

(12) United States Patent
An et al.

(10) Patent No.: US 10,683,874 B2
(45) Date of Patent: Jun. 16, 2020

(54) MULTI-STAGE ELECTRIC CENTRIFUGAL COMPRESSOR

(71) Applicant: MITSUBISHI HEAVY INDUSTRIES ENGINE & TURBOCHARGER, LTD., Sagamihara-shi, Kanagawa (JP)

(72) Inventors: Byeongil An, Tokyo (JP); Hiroshi Suzuki, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 307 days.

(21) Appl. No.: 15/106,342

(22) PCT Filed: Feb. 13, 2014

(86) PCT No.: PCT/JP2014/053328
§ 371 (c)(1),
(2) Date: Jun. 20, 2016

(87) PCT Pub. No.: WO2015/121945
PCT Pub. Date: Aug. 20, 2015

(65) Prior Publication Data

US 2016/0305450 A1 Oct. 20, 2016

(51) Int. Cl.
*F04D 29/58* (2006.01)
*F04D 25/06* (2006.01)
(Continued)

(52) U.S. Cl.
CPC ..... *F04D 29/5853* (2013.01); *F04D 25/06* (2013.01); *F04D 29/102* (2013.01);
(Continued)

(58) Field of Classification Search
CPC ..... F02B 39/10; F02B 33/44; F04D 17/122; F04D 17/12; F04D 29/58; F04D 29/5853;
(Continued)

(56) References Cited

U.S. PATENT DOCUMENTS 2,822,974 A * 2/1958 Mueller ..... F01D 25/08 415/186
5,856,992 A * 1/1999 Karube ..... F04D 29/102 372/58
(Continued)

FOREIGN PATENT DOCUMENTS

CN 102135104 A 7/2011
EP 0 982 502 A2 3/2000
(Continued)

OTHER PUBLICATIONS

Office Action dated Apr. 21, 2017 issued to the corresponding CN Application No. 201480069099.9 with a Machine English Translation.
(Continued)

*Primary Examiner* — Nathan C Zollinger
(74) *Attorney, Agent, or Firm* — Birch, Stewart, Kolasch & Birch, LLP

(57) ABSTRACT

A multi-stage electric centrifugal compressor including an electric motor free from risk of breakdown of an operation control part due to heat generated by low-pressure stage and high-pressure stage compressors. Includes an electric motor; a pair of centrifugal compressors comprising a low-pressure stage compressor and a high-pressure stage compressor connected in series; a heat-shielding plate configured to shield heat generated by the low-pressure stage compressor; and a bending portion disposed in middle of the heat-shielding plate, and extending along a rotational shaft of the electric motor so as to surround an outer periphery of the rotational shaft. An inner surface of the bending portion faces the rotational shaft via a clearance part, and the bending portion functions as a shaft sealing portion which prevents leakage of intake air from the low-pressure stage compressor.

12 Claims, 1 Drawing Sheet

(51) Int. Cl.

| | |
|---|---|
| ***F04D 29/10*** | (2006.01) |
| ***F04D 29/42*** | (2006.01) |
| ***F04D 29/12*** | (2006.01) |
| ***F04D 17/12*** | (2006.01) |
| ***F04D 29/28*** | (2006.01) |

(52) U.S. Cl.
CPC ..... *F04D 29/122* (2013.01); *F04D 29/4206* (2013.01); *F04D 17/122* (2013.01); *F04D 25/068* (2013.01); *F04D 29/286* (2013.01); *F05D 2240/15* (2013.01)

(58) Field of Classification Search
CPC ..... F04D 29/42; F04D 29/10; F04D 29/28; F04D 29/102; F04D 29/122; F04D 29/286; F04D 29/4206; F04D 29/16; F04D 29/44; F04D 29/46; F04D 25/06; F04D 25/068; F04D 29/5846; F04D 29/5806; F05D 2240/15; F04B 25/00; F04B 49/00; F04B 5/00; F04B 3/00; F04B 39/06; F04B 29/063; H02K 9/19; F04C 29/04; F04C 29/047; F25B 1/00
USPC ..... 417/212, 243, 423.5, 423.11, 350, 373; 60/605.3; 62/115, 510
See application file for complete search history.

(56) References Cited

U.S. PATENT DOCUMENTS

| | | | | |
|---|---|---|---|---|
| 5,980,218 | A | 11/1999 | Takahashi et al. | |
| 9,709,068 | B2 * | 7/2017 | Thompson | F04D 17/125 |
| 9,732,766 | B2 * | 8/2017 | Thompson | F04C 29/047 |
| 2003/0059315 | A1 * | 3/2003 | Choi | F04D 17/122 417/228 |
| 2004/0179947 | A1 * | 9/2004 | Agrawal | F04D 17/12 417/212 |
| 2009/0087299 | A1 * | 4/2009 | Agrawal | F04D 29/057 415/1 |
| 2010/0266430 | A1 * | 10/2010 | Shimizu | F02B 37/10 417/423.8 |
| 2013/0318797 | A1 * | 12/2013 | Royal | F04D 17/122 29/898.041 |

FOREIGN PATENT DOCUMENTS

| | | | |
|---|---|---|---|
| JP | 10-89296 | A | 4/1998 |
| JP | 2000-161297 | A | 6/2000 |
| JP | 2000-240596 | A | 9/2000 |
| JP | 2002-180841 | A | 6/2002 |
| JP | 2004-11440 | A | 1/2004 |
| JP | 2009-520141 | A | 5/2009 |
| JP | 44978709 | B2 | 7/2010 |
| JP | 2013-227889 | A | 11/2013 |

OTHER PUBLICATIONS

International Preliminary Report on Patentability and Written Opinion of the International Searching Authority (Forms PCT/IB/338, PCT/IB/326, PCT/IB/373 and PCT/ISA/237) for International Application No. PCT/JP2014/053328, dated Aug. 25, 2016, with an English translation.

International Search Report and Written Opinion of the International Searching Authority (Forms PCT/ISA/210, PCT/ISA/220 and PCT/ISA/237) for International Application No. PCT/JP2014/053328, dated Mar. 11, 2014.

Extended European Search Report dated Jan. 2, 2017 issued in the corresponding EP Application No. 14882385.9.

Office Action dated Jul. 16, 2018 issued to the corresponding Chinese Application No. 201480069099.9 with an English Translation.

* cited by examiner

MULTI-STAGE ELECTRIC CENTRIFUGAL COMPRESSOR

TECHNICAL FIELD

The present disclosure relates to a multi-stage electric centrifugal compressor including an electric motor and compressors disposed on either side of a rotational shaft extending from either side of the electric motor.

BACKGROUND ART

Engines, an example of an internal combustion engine, have been reduced in size, and there are growing needs for an increased low-speed torque and improved responsiveness. A multi-stage centrifugal compressor is attracting attention as an approach to meet such needs (see Patent Document 1). A multi-stage centrifugal compressor has a rotational shaft extending from either side of a rotary driving unit, a low-pressure stage compressor disposed on one end of the rotational shaft, and a high-pressure stage compressor connected to the opposite end of the rotational shaft and configured to re-compress intake air compressed by the low-pressure stage compressor.

If an electric motor is employed as the rotary driving unit of the above multi-stage centrifugal compressor, when the electric motor operates to drive the low-pressure stage compressor and the high-pressure stage compressor, intake air compressed by the low-pressure stage compressor has its temperature increased and generates heat, and so does intake air compressed by the high-pressure stage compressor. Accordingly, heat is accumulated in the multi-stage centrifugal compressor, and the electric motor may break down.

Thus, a motor housing that retains an electric motor is normally equipped with a plurality of heat-dissipating plates. Further, a centrifugal compressor utilizing a centrifugal force can be easily reduced in size, and thus an operation control part that controls operation of an electric motor is sometimes provided accommodated in a centrifugal compressor.

CITATION LIST

Patent Literature

Patent Document 1: JP2004-11440A

SUMMARY

Problems to be Solved

In recent years, besides a turbo assist function for the purpose of improvement of responsiveness at a low engine speed, turbo assist is also required during normal operation, which makes a usage environment of engines increasingly severe. Accordingly, even if heat generated by an electric motor driving a centrifugal compressor is dissipated through heat-dissipating plates, heat generated by a low-pressure stage compressor and a high-pressure stage compressor may not be dissipated sufficiently from the heat-dissipating plates, and may accumulate in a multi-stage centrifugal compressor. As a result, an operation control part, which is an electric component, may break down due to accumulated heat.

In view of the above, an object of at least some embodiments of the present invention is to provide a multi-stage electric centrifugal compressor which includes an electric motor but does not have a risk of breakdown of an operation control part due to heat generated by a low-pressure stage compressor and a high-pressure stage compressor.

Solution to the Problems

A multi-stage electric centrifugal compressor according to some embodiments of the present invention comprises: an electric motor; a pair of centrifugal compressors coupled to either side of the electric motor, the pair of centrifugal compressors comprising a low-pressure stage compressor and a high-pressure stage compressor connected in series; a heat-shielding plate disposed between an end portion on a low-pressure-stage-compressor side of the electric motor and an end portion on a motor-housing side of the low-pressure stage compressor, and configured to shield heat generated by the low-pressure stage compressor; and a bending portion disposed in the middle of the heat-shielding plate, and extending along a rotational shaft of the electric motor so as to surround an outer periphery of the rotational shaft. An inner surface of the bending portion faces the rotational shaft via a clearance part, and the bending portion functions as a shaft sealing portion which prevents leakage of intake air from the low-pressure stage compressor.

In the above multi-stage electric centrifugal compressor, the heat-shielding plate for shielding heat generated by the low-pressure stage compressor is disposed between the end portion of the electric motor on the side of the low-pressure stage compressor and the end portion of the low-pressure stage compressor on the side of the motor housing, and thereby it is possible to prevent heat, generated by intake air with an increased temperature from flowing through the low-pressure stage compressor, from propagating toward the electric motor. Thus, it is possible to obtain a multi-stage electric centrifugal compressor capable of protecting an electric component disposed on a motor housing from heat generated by a low-pressure stage compressor. Further, the bending portion is disposed in the middle of the heat-shielding plate, and extending along the rotational shaft so as to surround the outer periphery of the rotational shaft of the electric motor, with the inner surface of the bending portion facing the rotational shaft via the clearance part, so that the bending portion functions as a shaft sealing portion which prevents leakage of intake air from the low-pressure stage compressor. Accordingly, the bending portion functioning as a shaft sealing portion reduces leakage of intake air that may flow through the low-pressure stage compressor and inside the bending portion to leak out toward a bearing that supports the rotational shaft during operation of the low-pressure stage compressor. Thus, it is possible to reduce a risk of accumulation of heat in the multi-stage electric centrifugal compressor, which makes it possible to position electric components in the multi-stage electric centrifugal compressor, and to prevent a risk of damage to a bearing that supports the rotational shaft due to uneven arrangement of grease in the bearing. Further, the bending portion can utilize the inner surface of the bending portion as a guide member that determines the position during assembly of the multi-stage electric centrifugal compressor.

In some embodiments, an operation control part is disposed on the low-pressure-stage-compressor side of the motor housing, and configured to control operation of the electric motor.

In this case, the operation control part is disposed on the low-pressure-stage-compressor side of the motor housing, and thus positioned remote from the high-pressure stage compressor. Accordingly, it is possible to reduce an influence of heat generated by intake air that flows to the high-pressure stage compressor and gets heated. Further, while the operation control part is disposed near the low-pressure stage compressor, the heat-shielding plate is disposed between the operation control part and the low-pressure stage compressor, and thereby the heat-shielding plate shields heat generated by intake air that flows to the low-pressure stage compressor and gets heated, which reduces influence from heat on the operation control part. Thus, it is possible to obtain a multi-stage electric centrifugal compressor capable of protecting an operation control part from heat generated by a high-pressure stage compressor and a low-pressure stage compressor. Moreover, the low-pressure stage compressor normally generates heat of a lower temperature than the high-pressure stage compressor during operation, and thus it is desirable to position the operation control part, which is an electric component, on the side of the low-pressure stage compressor of a lower temperature.

Further, in some embodiments, the operation control part is disposed to have a gap from the heat-shielding plate.

In this case, the operation control part is disposed to have a gap from the heat-shielding plate, and thus it is possible to prevent effectively propagation of heat from the heat-shielding plate to the operation control part.

In some embodiments, the multi-stage electric centrifugal compressor further comprises: a seal-member fitting portion disposed on an outer periphery of the rotational shaft which faces the inner surface of the bending portion of the heat-shielding plate; and a ring disposed on an outer peripheral surface of the seal-member fitting portion and configured to slide relative to the inner surface of the bending portion.

In this case, the ring is disposed on the outer peripheral surface of the seal-member fitting portion and configured to slide relative to the inner surface of the bending portion, and thereby the outer peripheral surface of the seal-member fitting portion and the inner surface of the bending portion are in slide contact via the ring. Accordingly, during operation of the low-pressure stage compressor, it is possible to prevent leakage of intake air even more securely with the ring, even if intake air flowing through the low-pressure stage compressor passes through the bending portion and tries to leak out toward the bearing disposed on the rotational shaft. Thus, it is possible to prevent infiltration of high-temperature intake air into the electric motor more effectively, and to dispose electric components (operation control part) inside the multi-stage electric centrifugal compressor, which makes it possible to obtain a multi-stage electric centrifugal compressor free from risk of uneven arrangement of grease in a bearing that supports a rotational shaft. Herein, the seal-member fitting portion may be formed integrally with the rotational shaft, or may be a cylindrical sleeve fitted onto the rotational shaft.

In some embodiments, a plurality of the rings are disposed on the outer peripheral surface of the seal-member fitting portion, spaced from one another in an axial direction of the rotational shaft.

In this case, a plurality of the rings are disposed on the outer peripheral surface of the seal-member fitting portion, spaced from one another in the axial direction of the rotational shaft, and thereby the outer peripheral surface of the seal-member fitting portion and the inner surface of the bending portion are in contact with each other via the plurality of rings. Accordingly, the rings and the inner surface of the bending portion contact each other via a larger contact area, and thus it is possible to enhance the sealing function. Accordingly, during operation of the low-pressure stage compressor, it is possible to prevent leakage of intake air securely with the rings, even if intake air flowing through the low-pressure stage compressor passes through the bending portion and tries to leak out toward the bearing. Thus, it is possible to prevent infiltration of high-temperature intake air into the electric motor, and to prevent accumulation of heat in the multi-stage electric compressor securely, as well as to achieve a multi-stage electric centrifugal compressor free from risk of uneven arrangement of grease in a bearing.

In some embodiments, the low-pressure stage compressor is configured to have a lower compression ratio than the high-pressure stage compressor.

In this case, the low-pressure stage compressor is configured to have a lower compression ratio than the high-pressure stage compressor, and thereby it is possible to suppress a temperature increase in the vicinity of the operation control part and to reduce a pressure in the vicinity of the bending portion. Accordingly, it is possible to obtain a multi-stage electric centrifugal compressor with a reduced risk of breakdown of an operation control part.

Advantageous Effects

According to at least some embodiments of the present invention, it is possible to provide a multi-stage electric centrifugal compressor including an electric motor and an operation control part free from risk of breakdown due to heat generated by a low-pressure stage compressor and a high-pressure stage compressor.

DETAILED DESCRIPTION

Embodiments of the multi-stage electric centrifugal compressor of the present invention will now be described with reference to FIGS. 1A and 1B. The embodiments will be described referring to, as an example, a multi-stage electric centrifugal compressor including an electric motor and a pair of compressors disposed on either side of the electric motor. It is intended, however, that unless particularly specified, dimensions, materials, shapes, relative positions and the like of components described in the embodiments shall be interpreted as illustrative only and not intended to limit the scope of the present invention.

Figure 1A:
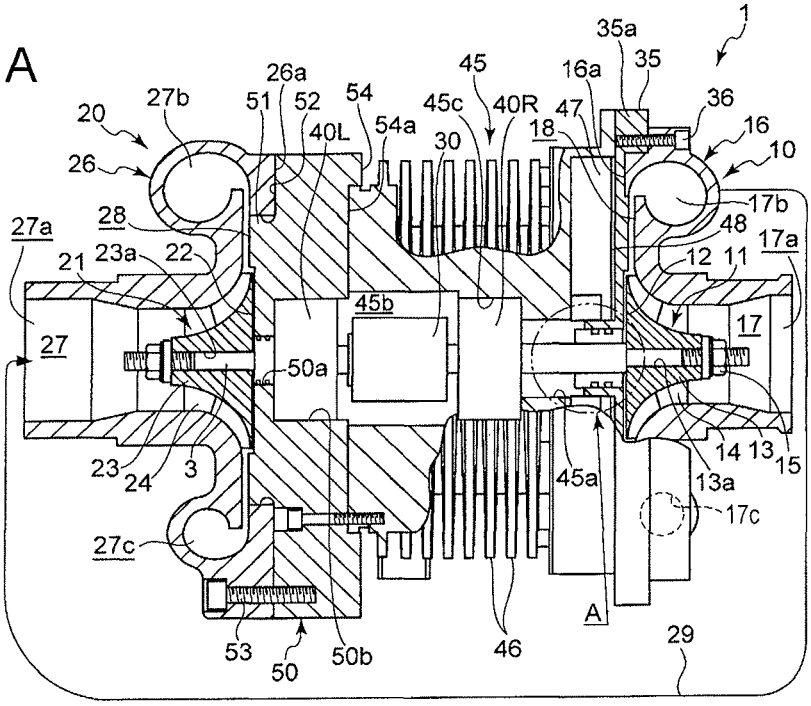
FIG. 1A is a cross-sectional view of a multi-stage electric centrifugal compressor.
Figure 1B:
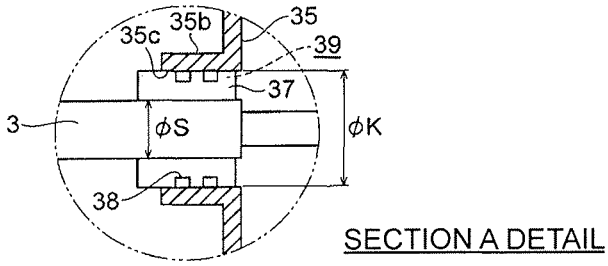
FIG. 1B is a partial enlarged view of a section indicated by arrow A in FIG. 1A.

As depicted in FIG. 1A (cross-sectional view), the multi-stage electric centrifugal compressor 1 includes a rotational shaft 3 supported rotatably, a low-pressure stage impeller 11 mounted to the first end of the rotational shaft 3, a high-pressure stage impeller 21 mounted to the second end of the rotational shaft 3, and an electric motor rotor 30 mounted to a middle section of the rotational shaft 3 in a longitudinal direction.

The low-pressure stage impeller 11 is disposed inside a low-pressure stage compressor 10 disposed on the first end of the multi-stage electric centrifugal compressor 1. The low-pressure stage compressor 10 includes the low-pressure stage impeller 11 mounted to the first end of the rotational shaft 3, and a low-pressure stage housing 16 surrounding the low-pressure stage impeller 11. The low-pressure stage housing 16 defines a space part 17 that accommodates the low-pressure stage impeller 11 rotatably. An inlet 17*a* for intake of intake air is disposed on the first end side of the space part 17, and a flow channel 17*c* is formed in a radial direction of the space part 17, the flow channel 17*c* communicating with the inlet 17*a* and curving in the circumferential direction of the low-pressure stage compressor 10. Further, an outlet 17*b* communicating with the flow channel 17*c* is disposed on an end portion on one side in the width direction of the low-pressure stage housing 16, i.e., on an end portion depicted in front of the page of FIG. 1A. Intake air enters through the inlet 17*a*, has its temperature increased by being compressed by the low-pressure stage impeller 11, flows through the flow channel 17*c*, and then exits through the outlet 17*b*.

An insertion opening 18 of a circular shape is disposed on the second end side of the low-pressure stage housing 16 in a side view, and the low-pressure stage impeller 11 can be inserted into the insertion opening 18. The insertion opening 18 is an opening larger than the low-pressure stage impeller 11, so that a part of the flow channel 17*b* is exposed. A side face 16*a* of the low-pressure stage housing 16 on the side of the insertion opening 18 has a flat shape and is formed in an annular shape in a side view.

A heat-shielding plate 35 is disposed on the second end side of the low-pressure stage compressor housing 16, and mounted to the side face 16*a* of the low-pressure stage compressor housing 16 so as to close the flow channel 17*c* being exposed. The heat-shielding plate 35 will be described below in detail. A motor housing 45 which retains the electric motor rotor 30 and a bearing 40R is mounted to a high-pressure-stage-compressor-20 side of the heat-shielding plate 35. The motor housing 45 will be described below in detail.

The low-pressure stage impeller 11 includes a back plate 12 of a disc shape, a boss portion 13 formed into a truncated conical shape and disposed integrally with the back plate 12 so as to protrude from a surface of the back plate 12 in a direction orthogonal to the surface of the back plate 12, and a plurality of vanes 14 formed integrally from an outer circumferential surface of the boss portion 13 to the back plate 12. A through hole 13*a* is disposed through the center of the boss portion 13, and the rotational shaft 3 is inserted into the through hole 13*a*, and thereby the low-pressure stage impeller 11 is mounted to the rotational shaft 3 via a nut 15. The low-pressure stage impeller 11 has a diameter smaller than that of the high-pressure stage impeller 21 of the high-pressure stage compressor 20, which will be described below. Thus, the low-pressure stage compressor 10 has a smaller pressure ratio than the high-pressure stage compressor 20.

The high-pressure stage compressor 20 has a configuration similar to that of the low-pressure stage compressor 10, and includes the high-pressure stage impeller 21 mounted to the second end side of the rotational shaft 3, and a high-pressure stage housing 26 surrounding the high-pressure stage impeller 21. The high-pressure stage housing 26 defines a space part 27 that accommodates the high-pressure stage impeller 21 rotatably. An inlet 27*a* for intake of intake air is disposed on the second end side of the space part 27, and a flow channel 27*c* is formed in a radial direction of the space part 27, the flow channel 27*c* communicating with the inlet 27*a* and curving in the circumferential direction of the high-pressure stage compressor 20. Further, an outlet 27*b* communicating with the flow channel 27*c* is disposed on an end portion on one side in the width direction of the high-pressure stage housing 26, i.e., on an end portion depicted in front of the page of FIG. 1A. Intake air enters through the inlet 27*a*, has its temperature increased by being compressed by the high-pressure stage impeller 21, flows through the flow channel 27*c*, and then exits through the outlet 27*b*. The inlet 27*a* of the high-pressure stage housing 26 is in communication with the outlet 17*b* of the low-pressure stage housing 16 via an intake-air communication passage 29.

An insertion opening 28 of a circular shape is disposed on the first end side of the high-pressure stage housing 26 in a side view, and the high-pressure stage impeller 21 can be inserted into the insertion opening 28. The insertion opening 28 is an opening larger than the high-pressure stage impeller 21, so that a part of the flow channel 27*c* is exposed. A side face 26*a* of the high-pressure stage housing 26 on the side of the insertion opening 28 has a flat shape and is formed in an annular shape in a side view.

The high-pressure stage impeller 21 has a configuration similar to that of the low-pressure stage impeller 11, and includes a back plate 22 of a disc shape, a boss portion 23 formed into a truncated conical shape and disposed integrally with the back plate 22 so as to protrude from a surface of the back plate 22 in a direction orthogonal to the surface of the back plate 22, and a plurality of vanes 24 formed integrally from an outer circumferential surface of the boss portion 23 to the back plate 22. A through hole 23*a* is disposed through the center of the boss portion 23, and the second end side of the rotational shaft 3 is inserted into the through hole 23*a*, and thereby the high-pressure stage impeller 21 is mounted to the second end side of the rotational shaft 3 via a nut 15. Accordingly, the low-pressure stage impeller 11 is mounted to the first end side of the rotational shaft 3, and the high-pressure stage impeller 21 is mounted to the second end side of the rotational shaft 3, so that the low-pressure stage impeller 11 and the high-pressure stage impeller 21 rotate integrally with the rotational shaft 3.

The high-pressure stage impeller 21 has a diameter larger than the above mentioned diameter of the low-pressure stage impeller 11. Thus, the high-pressure stage compressor 20 has a larger pressure ratio than the low-pressure stage compressor 10.

A pair of bearings 40R, 40L are disposed on either side of the rotational shaft 3 extending from either side of the electric motor rotor 30. The bearings 40R, 40L are roller bearings of grease type. The bearing 40L on the side of the high-pressure stage compressor 20, from among the bearings 40R, 40L, is disposed in a bearing housing 50.

The bearing housing 50 is formed into an annular shape, and has an insertion hole 50*a* in the middle, into which the rotational shaft 3 can be inserted. A bearing mounting hole 50*b* is disposed on a low-pressure-stage-compressor-10 side of the insertion hole 50*a*, and has a larger diameter than the insertion hole 50*a*. The bearing 40L is mounted to the bearing mounting hole 50*b*, and the rotational shaft 3 is inserted into the bearing 40L, and thereby the rotational shaft 3 is supported rotatably via the bearing 40L. A protruding stepped portion 51 having an annular shape in a side view is disposed on an end portion of the bearing housing 50 on the side of the high-pressure stage compressor 20, being fittable into the insertion opening 28 of the high-pressure stage housing 26, and a surface portion 52 of an annular shape is disposed radially outside the protruding stepped portion 51, facing and contacting the side face 26*a* of the high-pressure stage housing 26. The bearing housing 50 is fixed integrally to the high-pressure stage housing 26 via a bolt 53 inserted through the high-pressure stage housing 26.

A side face 54 of the bearing housing 50 disposed on the side of the low-pressure stage compressor 10 has an engaging recess portion 54*a* having a circular shape in a side view.

An end portion of the motor housing 45 disposed on the side of the high-pressure stage compressor 20 is inserted into the engaging recess portion 54*a*.

Meanwhile, the motor housing 45 has an insertion hole 45*a* into which the rotational shaft 3 is to be inserted, disposed on the first end side of the motor housing 45.

Further, a rotor space part 45*b* that surrounds the electric motor rotor 30 rotatably is disposed on the second end side of the motor housing 45, and a bearing mounting hole 45*c* to mount the bearing 40R is disposed between the insertion hole 45*a* and the rotor space part 45*b*. With the rotational shaft 3 inserted through the electric motor rotor 30 and the bearing 40R while the electric motor rotor 30 is disposed in the rotor space part 45*b* and the bearing 40R is disposed in the bearing mounting hole 45*c*, the rotational shaft 3 is rotatably supported and is rotatable in response to a driving force from the electric motor rotor 30. A plurality of fins 46 extending radially outward is disposed on an outer periphery of the motor housing 45, which makes it possible to dissipate heat generated by the electric motor rotor 30 and the bearing 40R, for instance.

The electric motor rotor 30 is a rotor of an electric motor, configured to rotate the rotational shaft 3 in response to a driving force with a motor coil (not depicted), and is capable of rotating at a high speed. Operation of the electric motor rotor 30 and the motor coil is controlled by an operation control part 47 described below.

The heat-shielding plate 35 for shielding heat generated by the low-pressure stage compressor 10 is disposed between an end portion of the motor housing 45 disposed on the side of the low-pressure stage compressor 10 and an end portion of the low-pressure stage compressor 10 disposed on the side of the motor housing 45. The heat-shielding plate 35 is formed into a disc shape, and a flange portion 35*a* formed into an annular shape is disposed on a rim part of the heat-shielding plate 35. The flange portion 35*a* is fixed to the low-pressure stage housing 16 via a bolt 36 while being in contact with a rim part of the low-pressure stage housing 16, and is fixed to the motor housing 45 via a bolt (not depicted) while being in contact with a rim part of the motor housing 45.

The heat-shielding plate 35 is formed to have a smaller thickness at the inside thereof than at the flange portion 35*a*. The inside of the heat-shielding plate 35 extends along the side face 16*a* of the low-pressure stage housing 16 so as to close the insertion opening 18 of the low-pressure stage housing 16. A bending portion 35*b* of a tubular shape is disposed in the middle of the heat-shielding plate 35, bending toward the bearing 40R to form an L shape and extending along an outer peripheral surface of the rotational shaft 3, in a side view. An inner surface 35*c* of the bending portion 35*b* is formed as a through hole into which the rotational shaft 3 is to be inserted. As depicted in FIG. 1B, the diameter φk of the inner surface 35*c* of the bending portion 35*b* is larger than the diameter φs of the rotational shaft 3.

Thus, a clearance part 39 is formed between the inner surface 35*c* of the bending portion 35*b* and the rotational shaft 3. A seal-member fitting portion 37 of a cylindrical shape is disposed on the clearance part 39, being fit onto an outer periphery of the rotational shaft 3. A piston ring 38 is mounted to an outer peripheral surface of the seal-member fitting portion 37, so as to slide relative to the inner surface 35*c* of the bending portion 35*b*. Two piston rings 38 are disposed, spaced from each other in the axial direction of the rotational shaft 3.

As depicted in FIG. 1A, the operation control part 47 for controlling operation of the electric motor rotor 30 is disposed on the low-pressure-stage-compressor-10 side of the motor housing 45. The operation control part 47 is housed inside the end portion of the motor housing 45 on the side of the low-pressure stage compressor 10, and a side face 16*a* of the operation control part 47 disposed on the side of the low-pressure stage compressor 10 is spaced from the heat-shielding plate 35 via a gap 48.

Next, operation of the multi-stage electric centrifugal compressor 1 will be described. When the electric motor rotor 30 is driven, the low-pressure stage impeller 11 and the high-pressure stage impeller 21 rotate along with rotation of the rotational shaft 3. In response to rotation of the low-pressure stage impeller 11, intake air enters through the inlet 17*a* of the low-pressure stage compressor 10, has its temperature increased by being compressed by the low-pressure stage impeller 11, flows through the flow channel 17*c* inside the low-pressure stage compressor 10 to reach a predetermined pressure, and then exits through the outlet 17*b*.

Intake air discharged from the outlet 17*b* flows through the intake-air communication passage 29 to flow into the high-pressure stage compressor 20 through the inlet 27*a* of the high-pressure stage compressor 20. Intake air having flowed into the high-pressure stage compressor 20 has its temperature increased by being compressed by the high-pressure stage impeller 21, flows through the flow channel 27*c* to reach a predetermined pressure, and then exits through the outlet 27*b*.

Herein, the operation control part 47 is disposed on the low-pressure-stage-compressor-10 side of the motor housing 45, and thus positioned remote from the high-pressure stage compressor 20. Accordingly, it is possible to reduce influence of heat generated by intake air that flows to the high-pressure stage compressor 20 and gets heated. Further, while the operation control part 47 is disposed near the low-pressure stage compressor 10, the heat-shielding plate 35 is disposed between the operation control part 47 and the low-pressure stage compressor 10, and thereby the heat-shielding plate 35 shields heat generated by intake air that flows to the low-pressure stage compressor 10 and gets heated. Accordingly, heat of intake air flowing through the low-pressure stage compressor 10 also has little influence on the operation control part 47. Further, in general, an increased temperature is lower in the low-pressure stage compressor 10 than in the high-pressure stage compressor 20, and thus electric components are desired to be disposed on the side of the low-pressure stage compressor 10. In view of this, in the present embodiment, the operation control part 47 is disposed on the side of the low-pressure stage compressor 10. Further, the operation control part 47 is disposed with a gap 48 provided between the heat-shielding plate 35 and the side face 16*a* of the operation control part 47 on the side of the low-pressure stage compressor 10, and thereby it is possible to more effectively prevent heat from the heat-shielding plate 35 from propagating to the operation control part 47. Thus, it is possible to achieve the multi-stage electric centrifugal compressor 1 capable of protecting the operation control part 47 from heat generated by the high-pressure stage compressor 20 and the low-pressure stage compressor 10.

Further, while intake air taken into the low-pressure stage compressor 10 flows through the flow channel 17*c* inside the low-pressure stage compressor 10 to be discharged through the outlet 17*b*, intake air may flow along the inner surface 35*c* of the heat-shielding plate 35 to leak out, in the middle of the flow channel 17*c*. In this regard, the bending portion 35*b* of a tubular shape is disposed in the middle of the heat-shielding plate 35 to bend toward the bearing 40R and extend along the outer peripheral surface of the rotational shaft 3, with the seal-member fitting portion 37 of a cylindrical shape fitted to the outer periphery of the rotational shaft 3 on the side of the inner surface 35*c* of the bending portion 35*b*, and with the plurality of piston rings 38 disposed on the outer peripheral surface of the seal-member fitting portion 37 to slide relative to the inner surface 35*c* of the bending portion 35*b*. Accordingly, during operation of the low-pressure stage compressor 10, the piston rings 38 and the seal-member fitting portion 37 can securely prevent leakage of intake air that may leak through a through hole. Therefore, it is possible to prevent infiltration of high-temperature intake air into the electric motor, and to prevent a risk of damage due to galling of the bearing 40R caused by grease shifting inside the bearing 40R and leaking out of the bearing 40R.

The embodiments of the present invention have been described above. However, the present invention is not limited thereto, and various modifications may be applied as long as they do not depart from the object of the present invention. For instance, some of the above described embodiments may be combined upon implementation.

DESCRIPTION OF REFERENCE NUMERALS

1 Multi-stage electric centrifugal compressor
3 Rotational shaft
10 Low-pressure stage compressor
11 Low-pressure stage impeller
12, 22 Back plate
13, 23 Boss portion
13*a*, 23*a* Through hole
14, 24 Vane
15 Nut
16 Low-pressure stage housing
16*a*, 26*a*, 54 Side face
17, 27 Space part
17*a*, 27*a* Inlet
17*b*, 27*b* Outlet
17*c*, 27*c* Flow Channel
18, 28 Insertion opening
20 High-pressure stage compressor
21 High-pressure stage impeller
26 High-pressure stage housing
29 Intake-air communication passage
30 Electric motor rotor
35 Heat-shielding plate
35*a* Flange portion
35*b* Bending portion
35*c* Inner surface
36, 53 Bolt
37 Seal-member fitting portion
38 Piston ring (ring)
39 Clearance part
40R, 40L Bearing
45 Motor housing
45*a*, 50*a* Insertion hole
45*b* Rotor space part
45*c*, 50*b* Bearing mounting hole
46 Fin
47 Operation control part
48 Gap
50 Bearing housing
51 Protruding stepped portion
52 Surface portion
54*a* Engaging recess portion
φk, φs Diameter

The invention claimed is:

1. A multi-stage electric centrifugal compressor, comprising:

an electric motor;

a pair of centrifugal compressors coupled to either side of the electric motor, the pair of centrifugal compressors comprising a low-pressure stage compressor and a high-pressure stage compressor connected in series;

a low-pressure stage housing which accommodates a low-pressure stage impeller of the low-pressure stage compressor;

a high-pressure stage housing which accommodates a high-pressure stage impeller of the high-pressure stage compressor;

a motor housing which accommodates the electric motor; and a heat-shielding plate disposed between an end portion on a low-pressure-stage-compressor side of the motor housing and an end portion on a motor-housing side of the low-pressure stage housing, the heat-shielding plate having a finite thickness and configured to shield heat generated by the low-pressure stage compressor, the heat-shielding plate being a plate-like member formed separately from the motor housing and the low-pressure stage housing;

wherein the heat-shielding plate includes a bending portion which bends toward the motor housing in the middle of the heat-shielding plate, and which extends beyond the finite thickness of the heat-shielding plate along a rotational shaft of the electric motor so as to surround an outer periphery of the rotational shaft, wherein an inner surface of the bending portion faces the rotational shaft via a clearance part, and the bending portion functions as a shaft sealing portion which prevents leakage of intake air from the low-pressure stage compressor.

2. The multi-stage electric centrifugal compressor according to claim 1, wherein the motor housing accommodates an operation control part including an electronic component disposed on the low-pressure-stage-compressor side of the electric motor, and configured to control operation of the electric motor.

3. The multi-stage electric centrifugal compressor according to claim 2, wherein the operation control part is disposed to have a gap from the heat-shielding plate.

4. The multi-stage electric centrifugal compressor according to claim 1, further comprising:

a seal-member fitting portion disposed on an outer periphery of the rotational shaft which faces the inner surface of the bending portion; and at least one ring disposed on an outer peripheral surface of the seal-member fitting portion and configured to slide relative to the inner surface of the bending portion.

5. The multi-stage electric centrifugal compressor according to claim 2, further comprising:

a seal-member fitting portion disposed on the outer periphery of the rotational shaft, the outer periphery facing the inner surface of the bending portion; and at least one ring disposed on an outer peripheral surface of the seal-member fitting portion and configured to slide relative to the inner surface of the bending portion.

6. The multi-stage electric centrifugal compressor according to claim 3, further comprising:

a seal-member fitting portion disposed on the outer periphery of the rotational shaft, the outer periphery facing the inner surface of the bending portion; and at least one ring disposed on an outer peripheral surface of the seal-member fitting portion and configured to slide relative to the inner surface of the bending portion.

7. The multi-stage electric centrifugal compressor according to claim 4, wherein the at least one ring comprises a plurality of the rings, each of the rings is disposed on the outer peripheral surface of the seal-member fitting portion, spaced from one another in an axial direction of the rotational shaft.

8. The multi-stage electric centrifugal compressor according to claim 5, wherein the at least one ring comprises a plurality of the rings, each of the rings is disposed on the outer peripheral surface of the seal-member fitting portion, spaced from one another in an axial direction of the rotational shaft.

9. The multi-stage electric centrifugal compressor according to claim 6, wherein the at least one ring comprises a plurality of the rings, each of the rings is disposed on the outer peripheral surface of the seal-member fitting portion, spaced from one another in an axial direction of the rotational shaft.

10. The multi-stage electric centrifugal compressor according to claim 2, wherein the low-pressure stage compressor is configured to have a lower compression ratio than the high-pressure stage compressor.

11. The multi-stage electric centrifugal compressor according to claim 3, wherein the low-pressure stage compressor is configured to have a lower compression ratio than the high-pressure stage compressor.

12. The multi-stage electric centrifugal compressor according to claim 1, wherein the heat-shielding plate includes a flange portion of an annular shape disposed on a rim part of the heat-shielding plate, wherein the flange portion and a rim part of the low-pressure stage housing are fixed via a fastening member, and wherein the flange portion and a rim part of the motor housing are fixed via a fastening member.

* * * * *